United States Patent [19]

Dunn

[11] Patent Number: 4,522,393

[45] Date of Patent: Jun. 11, 1985

[54] CENTER OF GRAVITY BLOCK REMOVAL, APPRAISAL AND BALANCING GAME

[76] Inventor: Richard A. Dunn, 42 Olympia St., Clifton, N.J. 07011

[21] Appl. No.: 532,687

[22] Filed: Sep. 16, 1983

[51] Int. Cl.[3] ..... A63F 9/00

[52] U.S. Cl. ..... 273/1 GF; 273/1 GG

[58] Field of Search ..... 273/1 GF, 1 GG

[56] References Cited

U.S. PATENT DOCUMENTS 2,188,043 1/1940 Harrison ..... 273/1 GG

OTHER PUBLICATIONS

Cadaco for 1970 Catalog, p. 5, 3-1970, #286, Tumble Logs.

Rules to "Ta-Ka-Radi Tiles" (a game) by Patricia Parsons, ©1980.

*Primary Examiner*—Paul E. Shapiro

*Attorney, Agent, or Firm*—M. K. Silverman; J. A. Giampapa

[57] ABSTRACT

A game made up of sixteen levels of criss-crossed platform blocks, each block being identical in length, width and height with every other block. The blocks, composed of material which has a weight and sliding characteristic which permits them to be easily removed from the stack, are pulled out one-at-a-time, from anywhere below the existing top layer at the respective players' discretion, then reinstated at an appropriate position back atop the stack. The process continues until one player is eliminated by reason of his or her induction of the collapse of the stack. A setup rack for the game, which may also serve as a storage and carrying case, is included.

2 Claims, 11 Drawing Figures

CENTER OF GRAVITY BLOCK REMOVAL, APPRAISAL AND BALANCING GAME

BACKGROUND OF THE INVENTION

Numerous games have been invented which are based on the idea of averting the collapse of a given structure. Many of these games are of the stacking variety and can be classified into two categories: (1) those that involve the removal of elements from a predetermined structure without causing it to fall apart, and (2) those that involve the continuous addition of elements to a structure in such a way as to avoid toppling it.

Representative of the aforementioned first category, the prior art reveals U.S. Pat. No. 3,712,616 (1973) to Goldfarb et. al., in which players are required to remove can-shaped elements from a pyramid structure without knocking over any other cans; and U.S. Pat. No. 3,471,147 (1969) to Glass et. al., in which players must remove elements from a structure composed of various platform levels and support posts without causing the structure to collapse. Representative of the second category are U.S. Pat. No. 4,293,128 (1981) to Ebel, wherein players continue to stack parallelpiped blocks on top of each other until the stack collapses; U.S. Pat. No. 3,863,918 (1974) to Kramer wherein players stack variously-shaped blocks one open the other to attempt to reach a maximum height; and U.S. Pat. No. 3,788,644 (1974) to Evans, in which players, while superimposing a multiplicity of movers in an interengaging relationship atop a pegged base, must prevent a column from falling over.

However none of the prior art concurrently presents features of both of said categories, which is the case in the present invention. In addition, the instant game is novel per se.

This invention is believed to be properly classified in U.S. Class 273, Subclasses 1 GF and 1 GG.

SUMMARY OF THE INVENTION

This invention relates generally to three-dimensional games and specifically to weight and balance type block games.

The invention includes a method of playing the game wherein a multi-level, criss-crossed stack of horizontal odd and even levels is formed, said levels consisting of rows of parallel, elongate, planar solid rectangular blocks; a player disengages one of said blocks from said stack using only the fingers of one hand, then places it in a new level on top of the previous uppermost level of the stack, again using only the fingers of one hand; and wherein such steps are repeated alternately by the players, with new levels started when and only when a prior level has been completed, until one player is eliminated by reason of causing the stack to collapse.

A principal object of this invention is to provide a game, and method of playing the same, suited to one or more players, that emphasizes accurate assessment of which supporting block in a defined block structure can be removed without causing the structure to collapse, and of where on the top of such structure a block can be replaced so as to make the balance more precarious for the next player, and which as well rewards a player's manual dexterity and "soft touch" in removing and replacing blocks from the structure.

It is a further object to provide a game which allows a player free choice as to which piece, from a set of completely uniform pieces, he will move instead of allowing random chance in the nature of turning cards from a deck or the rolling of dice to dictate a move.

It is a still further object to provide a specially-adapted rack to facilitate assembly of the game's initial structure, from which the pieces subsequently are removed and replaced, and which also serves as a storage container and carrying case for the game.

A yet further object of the invention is to provide a game whose pieces can take a variety of shapes and sizes and be formed of a variety of materials.

Another object is to provide a game that calls for physical as well as mental activity and yet is completely safe to play, can take as much or as little time to play as is desired, and which is not prohibitively expensive to make, use or buy.

Other objects and advantages of the invention will become more readily apparent from the Detailed Description and Drawings which follow. It is to be understood, however, that the invention is not limited to the embodiment illustrated and described below, as it may be embodied in other forms within the scope of the appended claims.

DETAILED DESCRIPTION OF THE PREFERRED EMBODIMENT

Figure 1:
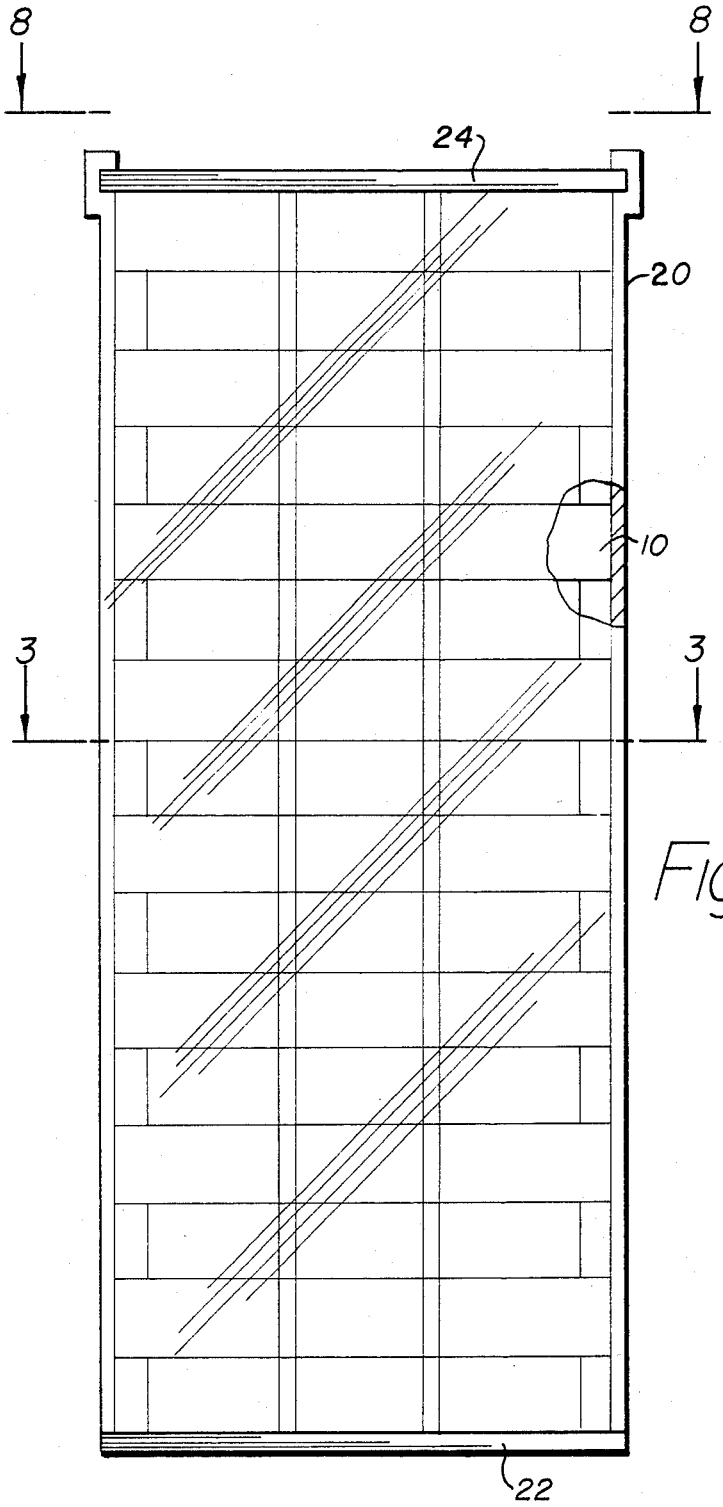
FIG. 1 is a plan view of the game enclosed within its assembly rack storage container/carrying case, setup and ready for said rack to be removed for play.
Figure 2:
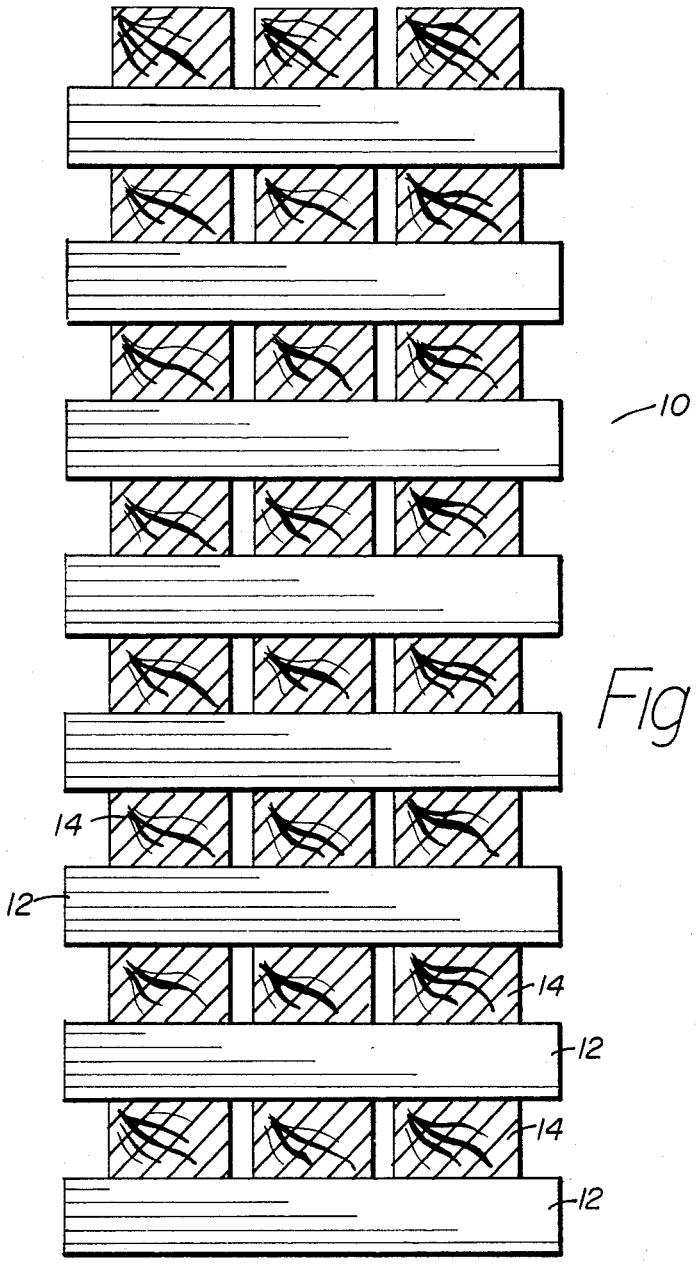
FIG. 2 is a view of the game at the start of play.
Figure 4A:
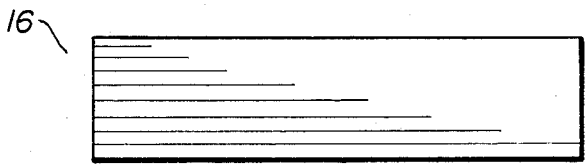
FIGS. 4A, 4B an 4C are, respectively, top, side and end views of a single playing piece of the present inventive structure.
Figure 4C:
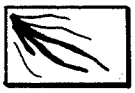
Figure 4B:
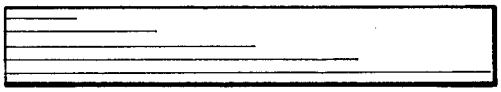

As illustrated in FIGS. 1 and 2, in the preferred embodiment, a game 10 comprises forty-eight playing pieces 16 (see FIG. 4) and a special assembly rack 20 for setting the game up and, as well, for carrying the game, as may be desired, from place to place. Each of the playing pieces 16 is a solid rectangular block of approximate dimensions $3\frac{1}{4}$inches long, $\frac{3}{4}$ of an inch wide, and $\frac{1}{2}$ inch thick, composed of a sturdy material such as wood or plastic. It is also necessary that each of the surfaces be smooth in order to (as hereinafter set forth more fully) enable the blocks to slide easily from beneath each other. The preferred configuation of the length, width and cross-section of the blocks is shown in FIGS. 4-A, B, and C. By means of the assembly rack 20, the playing pieces 16 are organized into a rectangular stack 10 which, preferrably, is sixteen levels high; said stack will have approximate dimensions of $3\frac{1}{4}$ inches long, $3\frac{1}{4}$ inches wide, and $8\frac{1}{4}$ inches high. The use of the rack 20 in combination with the individual pieces 16 generates a multi-level stack of horizontal odd and even levels 12 and 14 respectively (see FIG. 2), these blocks each being elongated solid rectangles of the type shown in FIG. 4 and each block being identical to each other in length and height.

Figure 3:
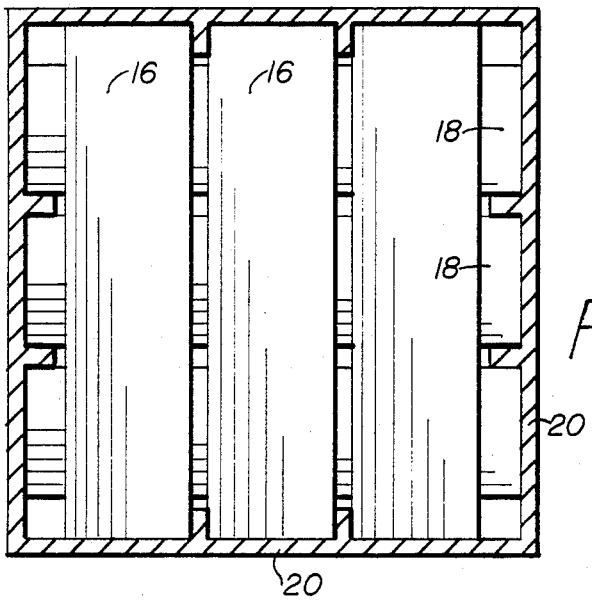
FIG. 3 is a cross-sectional view of FIG. 1 taken along Line 3—3.

As noted in FIGS. 2 and 3, said odd numbered levels 12 of stack 10 comprise three parallel rows 18 having their lengths precisely aligned and defining, by said odd numbered levels 12, a first plurality of horizontal planes. Very similarly, the even numbered levels 14 comprise three parallel rows 16 having their lengths precisely aligned and defining, by said even number levels, a second plurality of horizontal planes in which the rows of said even levels 14 are precisely orthogonal (see FIG. 3) to rows of said odd levels 12 and are horizontally and vertically balanced upon and between the rows of said odd levels.

The material of the platform block 16 must have a weight and a co-efficient of sliding friction which will permit the disengagement of the individual blocks from one level and the interengagement of said blocks onto a higher level.

Figure 5:
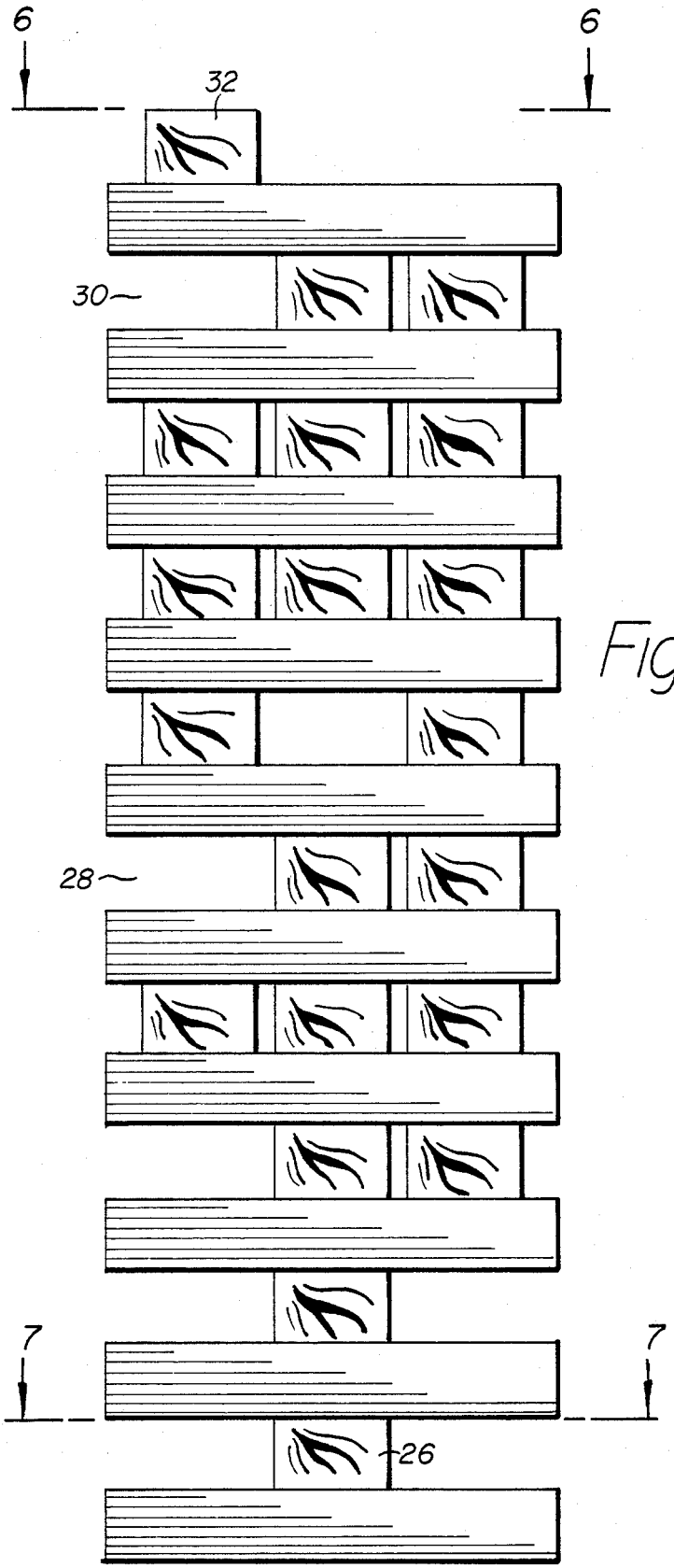
FIG. 5 is a frontal view of the stack as it might appear after several rounds of play, emphasizing the transverse imbalance of the structure as it is developed.
Figure 6:
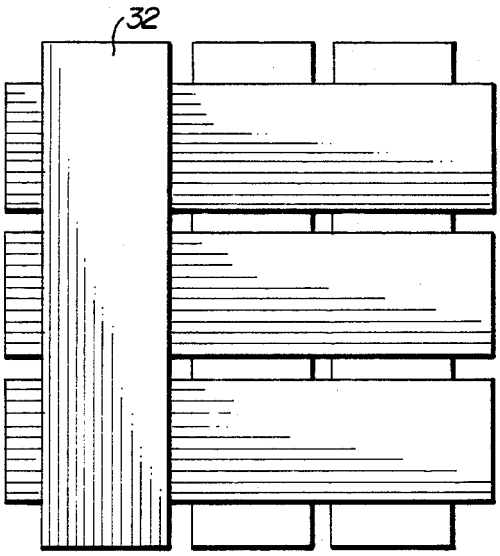
Figure 7:
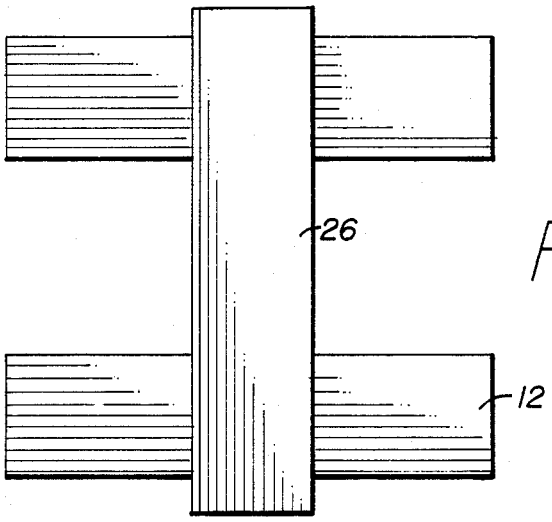
FIG. 7 is a cross-sectional view of FIG. 5 taken along Line 7—7 emphasizing a lower level of the structure as developed.

Additionally, in order for the game to provide sufficient challenge to a player, the ratio of the original height of the multi-level stack to the length of a row must be at least two-to-one. With such a structure, the elongate blocks 16 may be singularly and successively removed from any one level and then placed onto a new level and row, thereby forming a new level every third move on top of the previous uppermost level of the stack, this process alternating continuously by alternate players until one player is eliminated by reason of his induction of the collapse of the stack. The development of the game along these lines is illustrated in FIG. 5, with cross-sectional views thereof in FIGS. 6 and 7, wherein it may be appreciated that the game can only be won through a careful appraisal of the center of gravity of the stack and, thereafter, considerable skill in the removal of the lower level blocks and the interplacement thereof onto a higher level which will not disturb the balance of the structure of the stack 10 to a point of collapse.

It is to be appreciated that the initial set-up of the game is facilitated through the use of the multi-level rack 20, made of a transparent material and having internal grooves for the acceptance, guidance and arrangement of the blocks into the initial multi-level, criss-crossed configuration shown in FIG. 2. As above noted, the rack may further function as a storage container and a carrying case for the game.

The rules of play of the game are as follows:

1. When removing pieces from, or replacing pieces onto the stack, player may only use one hand at a time.
2. Both hands may not simultaneously touch the game at any time nor may any other body part or artificial aid such as a tweezer or pliers be used.
3. Players may not hold the bottom or top of the stack at any time during the play.
4. If the structure collapses by itself, the player who last moved is eliminated.

In view of the above, it may be appreciated and understood that the present invention, in addition to the structure set forth above, also is defined by a novel method of playing a balancing game which comprises the steps of: forming a multilevel, criss-cross stack of horizontal odd and even levels, such levels consisting of rows of parallel, elongate, planar solid rectangular blocks and, thereafter, disengaging one of said elongate blocks from said stack using only the fingers of one hand. Following such disengagement, the disengaged block must be placed in a new level on top of the previous uppermost level of the stack, again using only the fingers of one hand. The steps of disengaging and placing the removed block on top of the previous uppermost level are repeated, starting new levels when and only when a prior level has been completed, and these two steps alternately continuing by alternate players until one player is eliminated by reason of his induction of the collapse of the stack.

Figure 8:
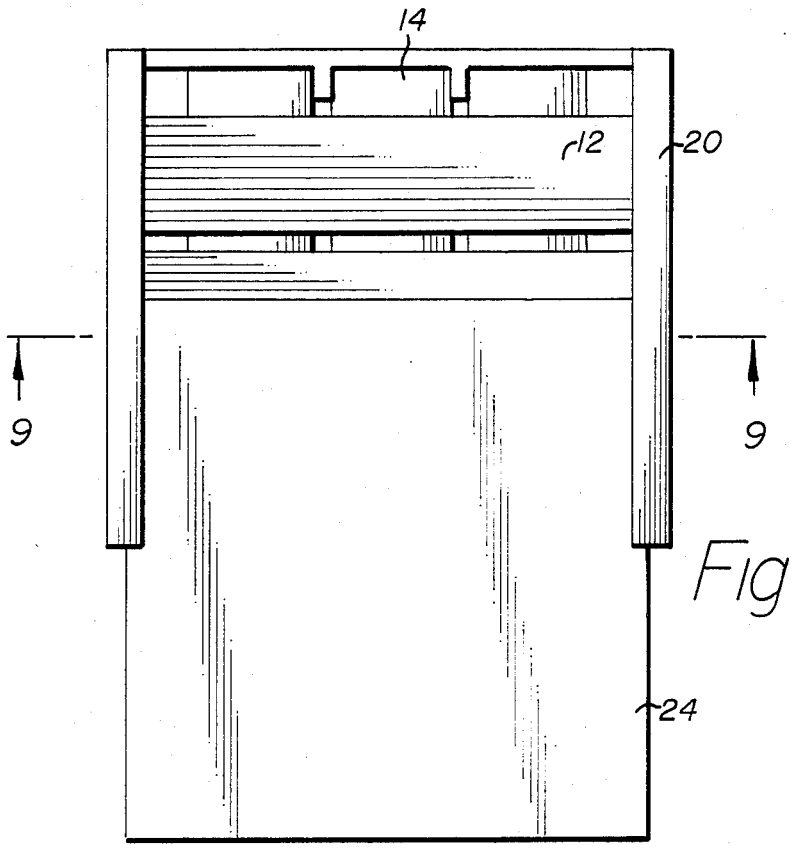
FIG. 8 is a plan view of the top of the assembly rack/storage container/carrying case, shown partially open.
Figure 9:
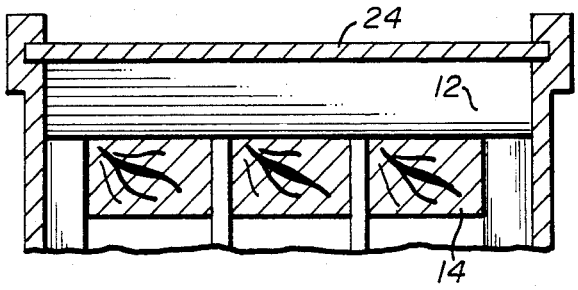
FIG. 9 is a cross-sectional view of FIG. 8 taken along Line 9—9.

In FIGS. 8 and 9, there is shown the top of the assembly rack/storage container/carrying case, as well as a cross-section through the center of such open position. By the illustration of these FIGS., it is intended to show that the rack may be provided with either a bottom 22 or a top 24 which, depending upon design preferences, may be selectively removed in order to permit the original placement of the piled stack either through the removal of the bottom 22 or by the removal of the top 24 followed by the inversion of the entire assembly rack in order to invert the pile prior to the beginning of play.

While the preferred embodiment of the invention has been shown and described, it will be understood that the invention may be embodied otherwise and that within such embodiments, certain changes in detail, construction and/or the form and arrangememt of the parts may be made without departing from the underlying ideas or principles of this invention within the scope of the appended claims.

Having thus described my invention, what I claim as new, useful and non-obvious and, accordingly, secure by Letters Patent of the Unites States is:

1. A center of gravity block removal, appraisal and balancing game structure, comprising:

(a) a sixteen level stack of horizontal odd and even levels consisting of elongate solid rectangular platform blocks, each block being identical in length, width and height to every other block, said blocks being approximately three (3) by three-quarters ($\frac{3}{4}$) by one-half ($\frac{1}{2}$) inch, in which said odd numbered levels of said stack comprise three parallel rows having their lengths precisely aligned and defining, by said odd numbered levels, a first plurality of horizontal planes, and said even numbered levels of said stack comprise three parallel rows having their lengths precisely aligned and defining, by said even numbered levels, a second plurality of horizontal planes in which the rows of said even levels are precisely orthogonal to the rows of said odd levels and are horizontally and vertically balanced upon and between the rows of said odd levels;

(b) the material of said platform blocks having a weight and coefficient of sliding friction permitting the disengagement of the individual blocks from one level and the inter-engagement of said blocks onto a higher level;

(c) the ratio of the original height of the sixteen level stack to the length of a row of a level of the stack being at least two-to-one; and (d) means for quick initial assembly of said sixteen level stack comprising a solid rectangular rack made of a transparent material having internal grooves for the acceptance, guidance and arrangement of said platform blocks into the initial sixteen level criss-crossed stack configuration defined above, wherein said rack may further function as a storage container and carrying case for the game structure;

whereby said elongate blocks may be singularly and successively removed from any one level and then placed onto a new level and row, thereby forming a new level every third move, on top of the previous uppermost level of the stack, this process alternately continuing by alternate players until one player is eliminated by reason of his induction of the collapse of the stack.

2. The method of playing a balancing game, comprising the steps of:

(a) forming a sixteen level, criss-crossed stack of horizontal odd and even levels, said levels consisting of rows of parallel, elongate, planar solid rectangular blocks, employing a rack having a plurality of alignment grooves in order to quickly and conveniently set up said sixteen level, criss-crossed stack;

(b) disengaging one of said elongate blocks from said stack using only the fingers of one hand;

(c) placing said one block in a new level on top of the previous uppermost level of the stack, again using only the fingers of one hand; and (d) repeating steps (b) and (c) above, starting new levels when and only when a prior level has been completed, these sets of steps (b) and (c) alternately continuing by alternate players until one player is eliminated by reason of his induction of the collapse of the stack.

* * * * *